US011656013B2

(12) United States Patent
Akaiwa et al.

(10) Patent No.: US 11,656,013 B2
(45) Date of Patent: May 23, 2023

(54) DISTRIBUTOR AND REFRIGERATION CYCLE APPARATUS

(71) Applicant: Mitsubishi Electric Corporation, Tokyo (JP)

(72) Inventors: Ryota Akaiwa, Tokyo (JP); Shinya Higashiiue, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 17 days.

(21) Appl. No.: 17/044,117

(22) PCT Filed: Jun. 5, 2018

(86) PCT No.: PCT/JP2018/021609

§ 371 (c)(1),
(2) Date: Sep. 30, 2020

(87) PCT Pub. No.: WO2019/234836

PCT Pub. Date: Dec. 12, 2019

(65) Prior Publication Data

US 2021/0140692 A1 May 13, 2021

(51) Int. Cl.
*F25B 41/42* (2021.01)
*F28F 9/22* (2006.01)

(52) U.S. Cl.
CPC ..... *F25B 41/42* (2021.01); *F28F 9/22* (2013.01)

(58) Field of Classification Search
CPC ..... F25B 41/42; F25B 41/48; F25B 41/45; F28F 9/22

(Continued)

(56) References Cited

U.S. PATENT DOCUMENTS 5,241,839 A * 9/1993 Hughes ..... F28F 9/0278 62/515
5,242,016 A * 9/1993 Voss ..... F25B 39/028 165/173

(Continued)

FOREIGN PATENT DOCUMENTS

CN 107940825 A 4/2018
JP S61-046367 U 3/1986

(Continued)

OTHER PUBLICATIONS

Extended European Search Report dated May 17, 2021, issued in corresponding European Patent Application No. 18921828.2.

(Continued)

*Primary Examiner* — Tho V Duong
*Assistant Examiner* — Raheena R Malik
(74) *Attorney, Agent, or Firm* — Posz Law Group, PLC

(57) ABSTRACT

A distributor includes an upstream flow path and a downstream flow path. The downstream flow path has a branch portion and a bent portion. The branch portion has a first connecting portion connected to the upstream flow path to branch a refrigerant flow from the first connecting portion in a second direction intersecting a first direction. The bent portion has a second connecting portion connected to the branch portion and is located downstream of the branch portion in the refrigerant flow. The second connecting portion of the bent portion is located downstream of the first connecting portion of the branch portion in the refrigerant flow.

6 Claims, 11 Drawing Sheets

(58) Field of Classification Search
USPC ..... 62/529
See application file for complete search history.

(56) References Cited

U.S. PATENT DOCUMENTS

| | | | | |
|---|---|---|---|---|
| 5,743,111 | A * | 4/1998 | Sasaki | F25B 13/00 165/110 |
| 6,892,805 | B1 * | 5/2005 | Valensa | F28F 9/0278 165/173 |
| 2003/0152488 | A1 * | 8/2003 | Tonkovich | B01F 25/431 428/137 |
| 2012/0180518 | A1 * | 7/2012 | Yukimoto | F25B 43/00 236/92 B |
| 2015/0362222 | A1 | 12/2015 | Matsuda et al. | |
| 2016/0116231 | A1 * | 4/2016 | Higashiiue | F28D 1/0476 165/174 |
| 2016/0169595 | A1 * | 6/2016 | Matsuda | F28F 9/0221 165/104.21 |
| 2016/0178292 | A1 * | 6/2016 | Matsui | F25B 39/022 165/104.21 |
| 2016/0202000 | A1 | 7/2016 | Higashiiue et al. | |
| 2018/0216858 | A1 | 8/2018 | Higashiiue et al. | |
| 2019/0170456 | A1 | 6/2019 | Matsui et al. | |
| 2020/0025427 | A1 * | 1/2020 | Higashiiue | F25B 39/00 |
| 2021/0140692 | A1 * | 5/2021 | Akaiwa | F25B 39/04 |

FOREIGN PATENT DOCUMENTS

| | | | |
|---|---|---|---|
| JP | H02-071063 | A | 3/1990 |
| JP | H02-069262 | U | 5/1990 |
| JP | H03-195874 | A | 8/1991 |
| JP | 2006-097987 | A | 4/2006 |
| JP | 3842999 | B2 | 11/2006 |
| JP | 2013-164216 | A | 8/2013 |
| JP | 2016-085000 | A | 5/2016 |
| WO | 2014/115240 | A1 | 7/2014 |
| WO | 2014/199484 | A1 | 12/2014 |
| WO | 2015/049727 | A1 | 4/2015 |
| WO | 2017/042866 | A1 | 3/2017 |
| WO | 2017/042867 | A1 | 3/2017 |

OTHER PUBLICATIONS

Office Action dated Aug. 25, 2021, issued in corresponding CN Patent Application No. 201880093916.2 (and English Machine Translation).

Office Action dated Aug. 17, 2021, issued in corresponding JP Patent Application No. 2020-523894 (and English Machine Translation).

International Search Report of the International Searching Authority dated Aug. 28, 2018 for the corresponding International application No. PCT/JP2018/021609 (and English translation).

Office Action dated Jun. 24, 2022 issued in the counterpart Chinese Application No. 201880093916.2 (and English translation).

Office Action dated Mar. 7, 2022 issued in counterpart CN Patent Application No. 201880093916.2 (with English translation).

Office Action dated Dec. 13, 2022 issued in corresponding European Patent Application No. 18921828.2.

* cited by examiner

DISTRIBUTOR AND REFRIGERATION CYCLE APPARATUS

CROSS REFERENCE TO RELATED APPLICATION

This application is a U.S. national stage application of PCT/JP2018/021609 filed on Jun. 5, 2018, the contents of which are incorporated herein by reference.

TECHNICAL FIELD

The present invention relates to a distributor and a refrigeration cycle apparatus.

BACKGROUND ART

In a conventional refrigeration cycle apparatus, a distributor for evenly flowing refrigerant to multiple refrigerant paths of a heat exchanger is used. For example, Japanese Patent No. 3842999 (PTL 1) discloses a two-branch distributor including a U-bend bent into a U-shape and an inflow pipe serving as a flow inlet of the U-bend. In the distributor disclosed in PTL 1, the inflow pipe is connected to a junction between a bent pipe portion and a straight pipe portion of the U-bend while avoiding the bent pipe portion.

CITATION LIST

Patent Literature

PTL 1: Japanese Patent No. 3842999

SUMMARY OF INVENTION

Technical Problem

In the distributor disclosed in PTL 1, gas-liquid two-phase refrigerant flows into the bent pipe portion of the U-bend while spreading from the inflow pipe, and accordingly, part of the gas-liquid two-phase refrigerant flows into the bent pipe portion without contacting the straight pipe portion. As a result, a large amount of gas-liquid two-phase refrigerant flows through the bent pipe portion, which makes it difficult to evenly distribute the refrigerant to the bent pipe portion and the straight pipe portion. Such uneven distribution of the refrigerant may lead to lower-efficiency heat exchange in the heat exchanger.

The present invention has been made in view of the above problem and has an object to provide a distributor that facilitates even distribution of refrigerant and a refrigeration cycle apparatus including the distributor.

Solution To Problem

A distributor of the present invention includes an upstream flow path and a downstream flow path. The upstream flow path extends in a first direction. The downstream flow path is located downstream of the upstream flow path in a refrigerant flow. The downstream flow path has a branch portion and a bent portion. The branch portion has a first connecting portion connected to the upstream flow path to branch the refrigerant flow from the first connecting portion in a second direction intersecting the first direction. The bent portion has a second connecting portion connected to the branch portion and is located downstream of the branch portion in the refrigerant flow. The second connecting portion of the bent portion is located downstream of the first connecting portion of the branch portion in the refrigerant flow.

Advantageous Effects of Invention

In the distributor according to the present invention, the second connecting portion of the bent portion is located downstream of the first connecting portion of the branch portion in the refrigerant flow, and accordingly, the refrigerant flows through the branch portion from the first connecting portion to the second connecting portion. The refrigerant flowing from the first connecting portion into the branch portion while spreading is thus restrained from flowing into the bent portion without contacting the branch portion. The refrigerant flow is thus easily branched evenly in the branch portion. This facilitates even distribution of the refrigerant.

DESCRIPTION OF EMBODIMENTS

Figure 1:
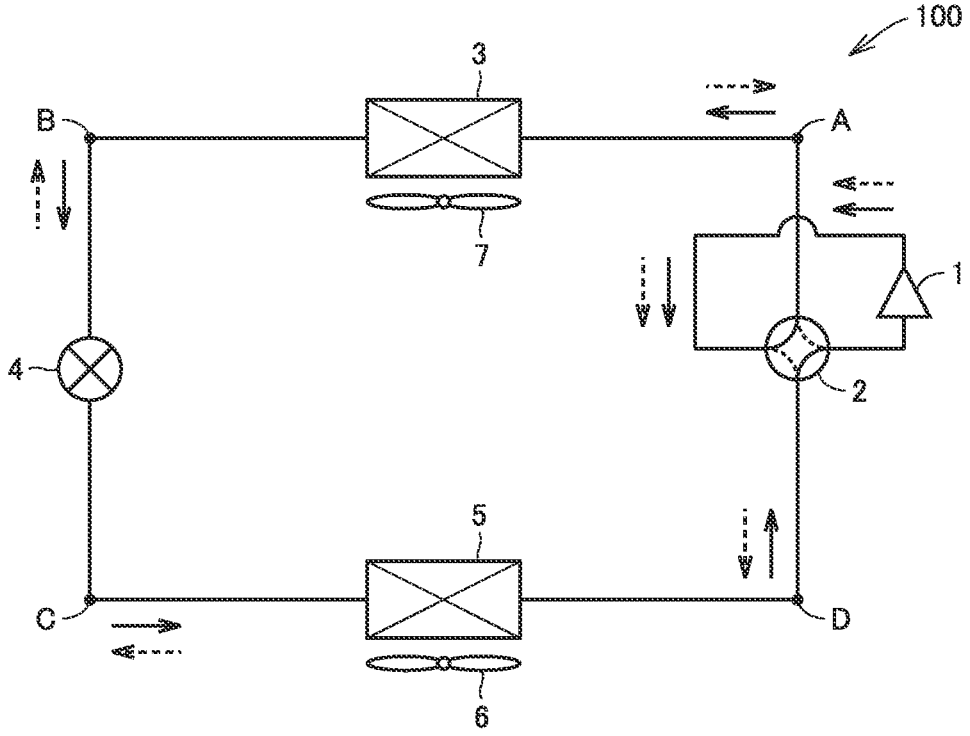
FIG. 1 schematically shows a refrigeration cycle apparatus in Embodiment 1 of the present invention.

Embodiments of the present invention will be described below with reference to the drawings. In the drawings described hereinafter, identical or corresponding parts are identically denoted, which is common throughout the specification. Also, the modes of the constituent elements described throughout the specification are merely by way of example, and they are not limited to the embodiments described herein.

Embodiment 1

A refrigeration cycle apparatus 100 in Embodiment 1 of the present invention will be described with reference to FIG. 1. FIG. 1 shows a configuration of refrigeration cycle apparatus 100 in the present embodiment and also shows refrigerant flows during heating operation and during cooling operation. Refrigeration cycle apparatus 100, such as a room-air conditioner for home use or a package air conditioner for store or office use, in which one outdoor heat exchanger and one indoor heat exchanger are mounted, will be described below by way of example. Refrigeration cycle apparatus 100 according to the present embodiment can be used in, for example, a heat pump apparatus, a water heater, or a refrigeration apparatus.

Refrigeration cycle apparatus 100 in the present embodiment includes a compressor 1, a four-way valve 2, an indoor heat exchanger 3, an expansion valve 4, an outdoor heat exchanger 5, an outdoor fan 6, and an indoor fan 7. Compressor 1, four-way valve 2, indoor heat exchanger 3, expansion valve 4, and outdoor heat exchanger 5 are connected to each other by pipes.

Compressor 1 is configured to compress sucked refrigerant and discharge the refrigerant. Four-way valve 2 is configured to switch refrigerant flows to indoor heat exchanger 3 and outdoor heat exchanger 5 between during heating operation and during cooling operation. Indoor heat exchanger 3 serves to perform heat exchange between the refrigerant and indoor air. Expansion valve 4 is a throttle device that decompresses the refrigerant. Expansion valve 4 is, for example, a capillary tube or an electronic expansion valve. Outdoor heat exchanger 5 serves to perform heat exchange between the refrigerant and outdoor air.

During heating operation, indoor heat exchanger 3 functions as a condenser, and outdoor heat exchanger 5 functions as an evaporator. During cooling operation, indoor heat exchanger 3 functions as an evaporator, and outdoor heat exchanger 5 functions as a condenser. Each of indoor heat exchanger 3 and outdoor heat exchanger 5 includes, for example, a heat transfer tube PI, through which the refrigerant flows, and fins FI, which are attached to the outside of heat transfer tube PI (see FIG. 2). Outdoor fan 6 is configured to supply air to outdoor heat exchanger 5. Indoor fan 7 is configured to supply air to indoor heat exchanger 3.

In FIG. 1, the refrigerant flow during heating operation is indicated by the solid line, and the refrigerant flow during cooling operation is indicated by the broken line. During heating operation, high-temperature, high-pressure gas refrigerant compressed by compressor 1 flows through four-way valve 2 and through a point A into indoor heat exchanger 3. The gas refrigerant condenses while flowing through indoor heat exchanger 3, and is cooled by the air flowed by indoor fan 7 to be liquefied. The liquid refrigerant after the liquefaction flows through a point B into expansion valve 4. The liquid refrigerant flows through expansion valve 4 to enter a two-phase refrigerant state in which low-temperature, low-pressure gas refrigerant and liquid refrigerant coexist.

The refrigerant in the two-phase refrigerant state flows through a point C into outdoor heat exchanger 5. The two-phase refrigerant evaporates while flowing through outdoor heat exchanger 5, and is heated by the air flowed by outdoor fan 6 to be gasified. The gas refrigerant after the gasification flows through a point D into four-way valve 2. The gas refrigerant returns to compressor 1 through four-way valve 2. Through such a cycle, a heating operation of heating indoor air is performed.

During cooling operation, four-way valve 2 is switched so as to flow refrigerant in a direction opposite to that during heating operation. In other words, the high-temperature, high-pressure gas refrigerant compressed by compressor 1 flows through four-way valve 2 and through point D into outdoor heat exchanger 5. The gas refrigerant condenses while flowing through outdoor heat exchanger 5 and is cooled by the air flowed by outdoor fan 6 to be liquefied. The liquid refrigerant after the liquefaction flows through point C into expansion valve 4. The liquid refrigerant flows through the expansion valve to enter the two-phase refrigerant state in which low-temperature, low-pressure gas refrigerant and liquid refrigerant coexist.

The refrigerant in the two-phase refrigerant state flows through point B into indoor heat exchanger 3. The two-phase refrigerant evaporates while flowing through indoor heat exchanger 3 and is heated by the air flowed by indoor fan 7 to be gasified. The gas refrigerant after the gasification flows through point A into four-way valve 2. The gas refrigerant returns to compressor 1 through four-way valve 2. Through such a cycle, a cooling operation of cooling indoor air is performed.

Next, a heat exchanger in the present embodiment will be described with reference to FIG. 2. The present embodiment will describe, by way of example, a configuration in which a heat exchanger is used as outdoor heat exchanger 5 during heating operation in refrigeration cycle apparatus 100. The heat exchanger of the present embodiment can also be used as indoor heat exchanger 3.

Figure 2:
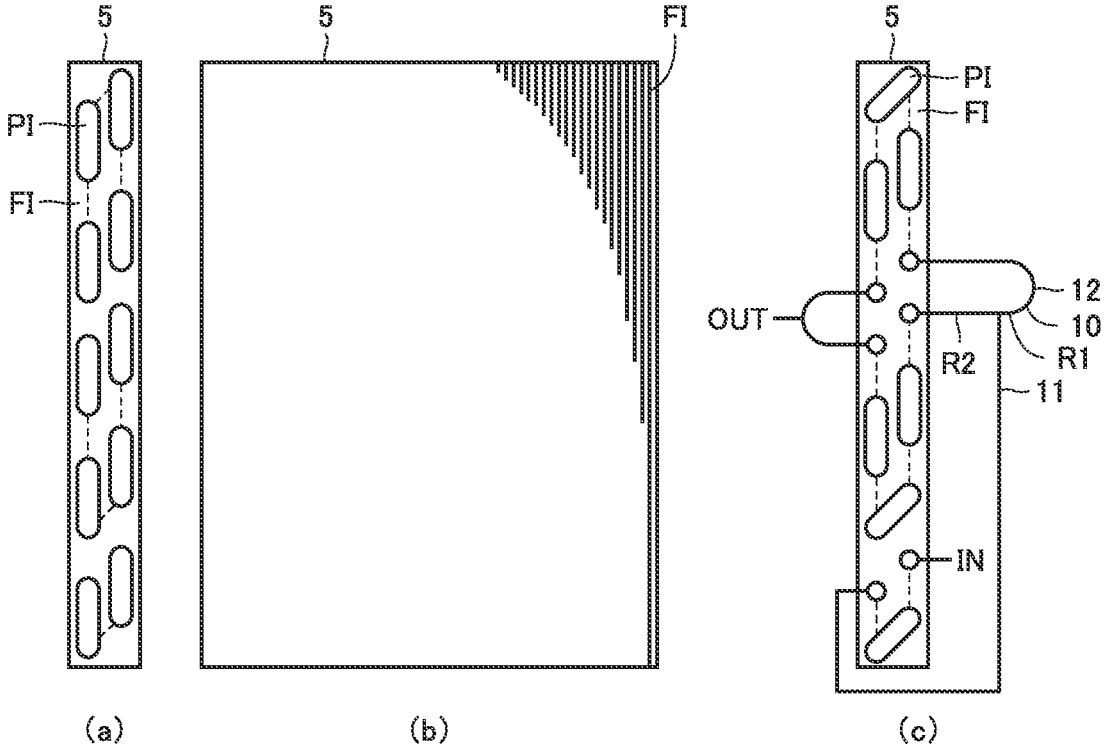
FIG. 2 schematically shows a heat exchanger in Embodiment 1 of the present invention.

FIG. 2 schematically shows outdoor heat exchanger 5 in the present embodiment. FIG. 2(*a*) is a left lateral view of outdoor heat exchanger 5. FIG. 2(*b*) is a front view of outdoor heat exchanger 5. FIG. 2(*c*) is a right lateral view of outdoor heat exchanger 5. For the purpose of illustration, FIG. 2(*b*) does not show heat transfer tube PI and shows only some of fins FI.

Outdoor heat exchanger 5 includes heat transfer tube PI, fins FI, and a distributor 10. Heat transfer tube PI passes through fins FI. Heat transfer tube PI includes a plurality of straight portions extending so as to pass through fins FI. The straight portions are connected in series with each other. Distributor 10 is connected to two straight portions.

In outdoor heat exchanger 5, gas-liquid two-phase refrigerant which has flowed in from an inflow portion IN in FIG. 2(*c*) flows through part of outdoor heat exchanger 5 and is subjected to heat exchange with the air flowed by outdoor fan 6 (FIG. 1). At this time, when a degree of dryness X, indicating a ratio of a mass velocity of gas to an overall mass velocity of gas-liquid two-phase refrigerant, is used, degree of dryness X is about 0.05 or more and about 0.25 or less (X=0.05-0.25). As the liquid refrigerant of the gas-liquid two-phase refrigerant evaporates through heat exchange between the refrigerant and air, the gas-liquid two-phase refrigerant completes flowing through part of outdoor heat exchanger 5 at a varying ratio of the mass velocity of gas to the overall mass velocity.

Then, distributor 10 of two-branch type distributes the gas-liquid two-phase refrigerant to a flow path R1 and a flow path R2. At this time, the gas-liquid two-phase refrigerant that flows into distributor 10 can have a degree of dryness X of about 0.10 or more and about 0.60 or less (0.10-0.60). This degree of dryness depends on a ratio of a part of outdoor heat exchanger 5, through which the gas-liquid two-phase refrigerant flows before reaching distributor 10, to the entire outdoor heat exchanger 5. The gas-liquid two-phase refrigerant which has flowed through flow path R1 and the gas-liquid two-phase refrigerant which has flowed through flow path R2 flow through other parts of outdoor heat exchanger 5 and meet together after being subjected to heat exchange with air. Then, the resultant gas-liquid two-phase refrigerant reaches an outflow portion OUT.

Figure 3:
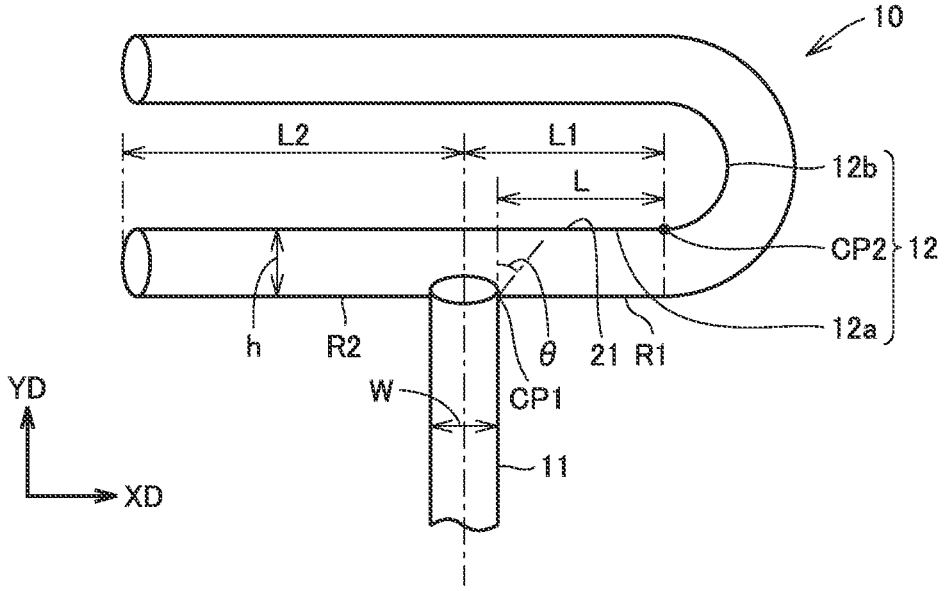
FIG. 3 schematically shows a distributor in Embodiment 1 of the present invention.

Distributor 10 in the present embodiment will be described in detail with reference to FIG. 3. FIG. 3 schematically shows distributor 10 in the present embodiment. As shown in FIG. 3, distributor 10 in the present embodiment includes an upstream flow path 11 and a downstream flow path 12. Each of upstream flow path 11 and downstream flow path 12 may be configured of a tube (pipe).

Upstream flow path 11 extends in a first direction YD. Upstream flow path 11 is connected to downstream flow path 12. A portion of upstream flow path 11 which is connected to downstream flow path 12 may be configured as a linear portion. Upstream flow path 11 is also connected to heat transfer tube PI. In other words, one end of upstream flow path 11 is connected to downstream flow path 12, and the other end of upstream flow path 11 is connected to heat transfer tube PI.

Downstream flow path 12 is located downstream of upstream flow path 11 in refrigerant flow. Downstream flow path 12 has a branch portion 12*a* and a bent portion 12*b*. Branch portion 12*a* has a first connecting portion CP1 connected to upstream flow path 11. Branch portion 12*a* is configured to branch a refrigerant flow from first connecting portion CP1 in a second direction XD intersecting first direction YD. Branch portion 12*a* is configured to branch a refrigerant flow from first connecting portion CP1 to flow path R1 and flow path R2. Branch portion 12*a* extends in second direction XD. First direction YD and second direction XD may be orthogonal to each other. Branch portion 12*a* may be configured as a straight portion.

Bent portion 12*b* is configured to bend with respect to branch portion 12*a*. In the present embodiment, bent portion 12*b* extends opposite to upstream flow path 11. Bent portion 12*b* is also configured to fold back downstream flow path 12 from the positive direction to the negative direction of second direction XD. Bent portion 12*b* has a second connecting portion CP2 connected to branch portion 12*a*. Bent portion 12*b* is located downstream of branch portion 12*a* in refrigerant flow. Second connecting portion CP2 of bent portion 12*b* is located downstream of first connecting portion CP1 of branch portion 12*a* in refrigerant flow. In second direction XD, thus, a length L between first connecting portion CP1 and second connecting portion CP2 is greater than zero.

Figure 4:
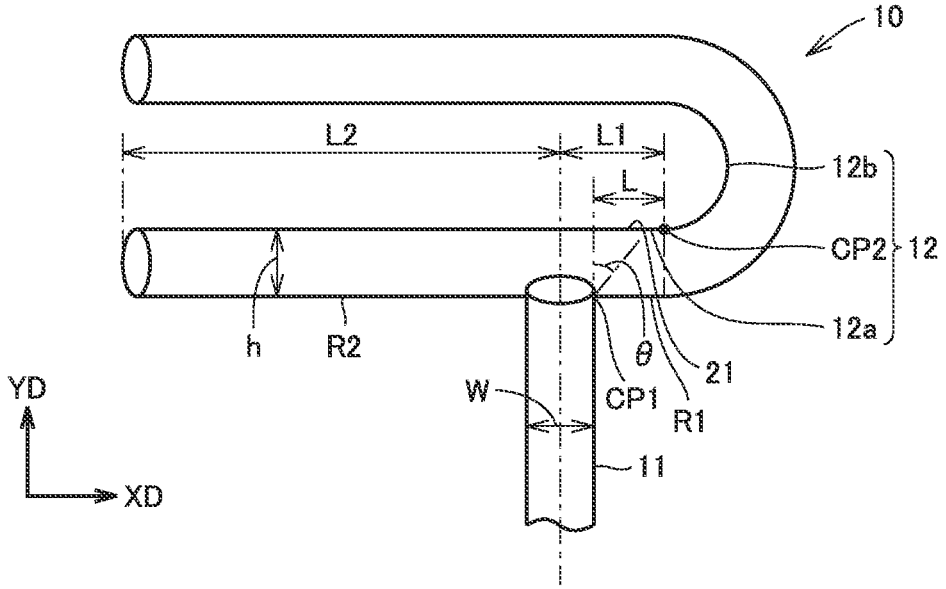
FIG. 4 schematically shows a distributor in Modification 1 of Embodiment 1 of the present invention.

Distributor 10 in Modification 1 of the present embodiment will be described with reference to FIG. 4. In distributor 10 in Modification 1 of the present embodiment, in second direction XD, length L between first connecting portion CP1 and second connecting portion CP2 is greater than or equal to a width W of upstream flow path 11, as shown in FIG. 4. In this case, width W of upstream flow path 11 is the upper limit of length L.

Figure 5:
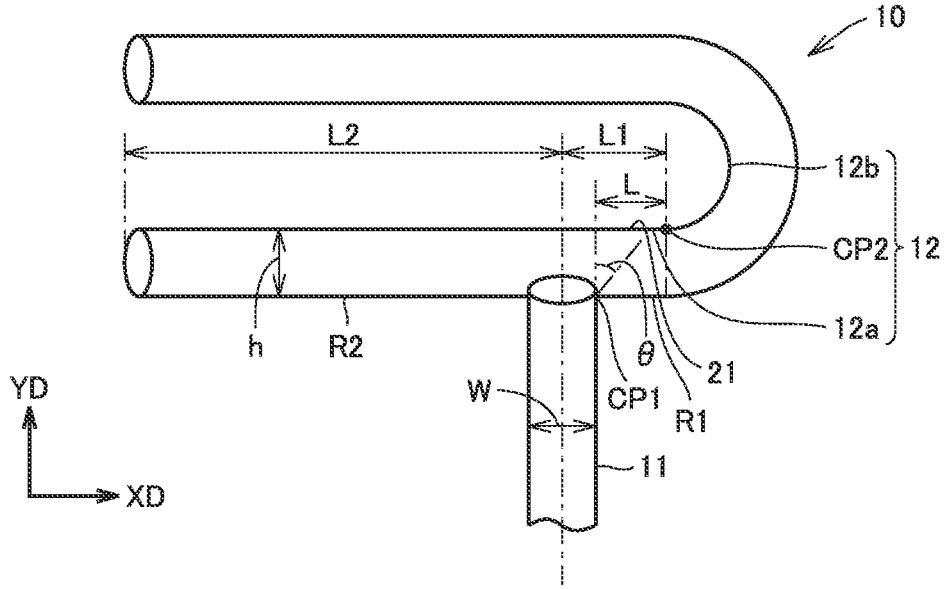
FIG. 5 schematically shows a distributor in Modification 2 of Embodiment 1 of the present invention.

Distributor 10 in Modification 2 of the present embodiment will be described with reference to FIG. 5. In distributor 10 in Modification 2 of the present embodiment, in second direction XD, length L between first connecting portion CP1 and second connecting portion CP2 is greater than or equal to a dimension obtained by multiplying a width h of branch portion 12*a* in first direction YD by tan 15°, as shown in FIG. 5.

As gas-liquid two-phase refrigerant that has flowed from upstream flow path 11 into downstream flow path 12 flows in the positive direction of first direction YD, the gas-liquid two-phase refrigerant collides with a traverse wall 21 of branch portion 12*a* while spreading from first connecting portion CP1 in the range of a spread angle θ. Spread angle θ is an angle at which refrigerant spreads from first connecting portion CP1 in second direction XD with respect to first direction YD.

Traverse wall 21 faces the flow outlet of upstream flow path 11. Branch portion 12*a* has a length L1 of flow path R1 and a length L2 of flow path R2 in second direction XD. One gas-liquid two-phase refrigerant that has collided with traverse wall 21 flows through flow path R1 in the positive direction of second direction XD and travels a distance of length L1 with width h, and then travels toward bent portion 12*b*. The other gas-liquid two-phase refrigerant that has collided with traverse wall 21 flows through flow path R2 in the negative direction of second direction XD and travels a distance of length L2 with width h. Herein, length L1 and length L2 have relations represented by Expressions (1) and (2) below.

$$L2 \geq L1 \geq h \tan \theta + 0.5W \quad (1)$$

$$\theta = 15° \quad (2)$$

Even at the same mass velocity, the speed of the gas-liquid two-phase refrigerant flowing per unit time increases as degree of dryness X is higher, resulting in a larger pressure loss caused by the collision with traverse wall 21. Thus, spread angle θ of the gas-liquid two-phase refrigerant tends to be large so as to avoid a pressure loss caused by a collision. In view of the above, the inventor has found through experimental research that spread angle θ in Expression (2) less easily exceeds 15 degrees (θ=15°) if degree of dryness X used in outdoor heat exchanger 5 is 0.10 or more and 0.60 or less (X=0.10-0.60). Thus, distributor 10 of two-branch type that satisfies the relations of Expressions (1) and (2) above can be mounted in a heat exchanger with a minimum length L1.

Figure 6:
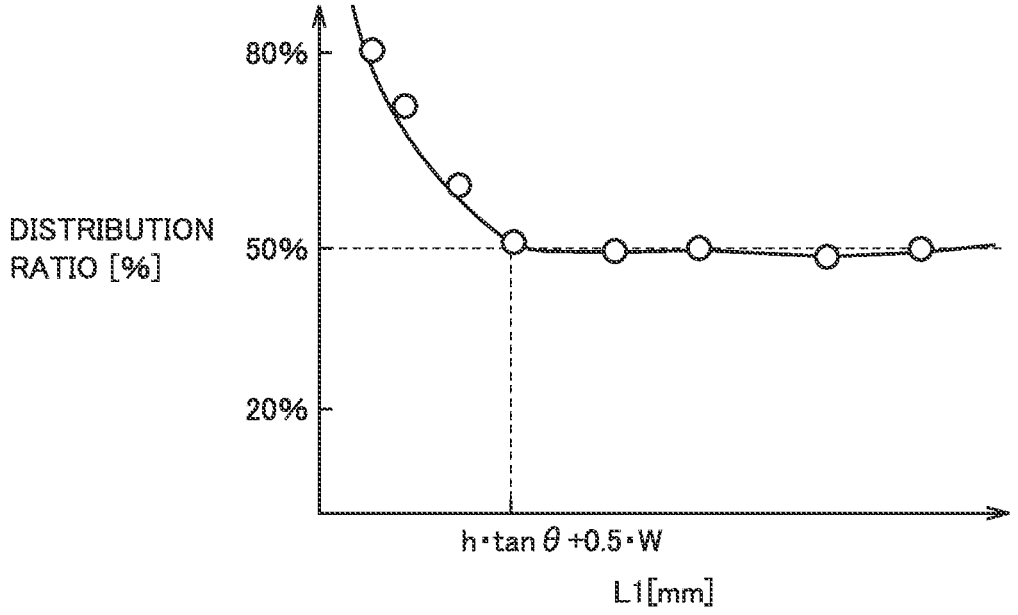
FIG. 6 is a graph showing a relation between a distance from a first connecting portion to a second connecting portion and a distribution ratio of a flow into a bent portion in Embodiment 1 of the present invention.

FIG. 6 is a characteristic diagram showing length L1 of flow path R1 of branch portion 12*a* and a distribution ratio of a mass flow rate at which refrigerant flows on the bent portion 12*b* side in the present embodiment, where a mass flow rate at which refrigerant flows through upstream flow path 11 is 100%. FIG. 6 reveals that refrigerant is distributed evenly when length L1 satisfies the relation of Expression (1), whereas refrigerant of a large mass flow rate flows on the bent portion 12*b* side when length L1 does not satisfy the relation of Expression (1).

Next, the function and effect of the present embodiment will be described.

In distributor 10 according to the present embodiment, second connecting portion CP2 of bent portion 12*b* is located downstream of first connecting portion CP1 of branch portion 12*a* in refrigerant flow, and accordingly, refrigerant flows through branch portion 12*a* from first connecting portion CP1 to second connecting portion CP2. This restrains refrigerant flowing from first connecting portion CP1 into branch portion 12*a* while spreading from flowing into the bent portion without contacting branch portion 12*a*. The refrigerant flow can thus be easily branched evenly in branch portion 12*a*. This facilitates even distribution of the refrigerant. This leads to higher-efficiency heat exchange in the heat exchanger.

In distributor 10 according to Modification 1 of the present embodiment, in second direction XD, length L between first connecting portion CP1 and second connecting portion CP2 is smaller than or equal to width W of upstream flow path 11. This can reduce a size of distributor 10.

In distributor 10 according to Modification 2 of the present embodiment, in second direction XD, length L between first connecting portion CP1 and second connecting portion CP2 is greater than or equal to a dimension obtained by multiplying width h of branch portion 12*a* in first direction YD by tan 15°. This enables even distribution of the refrigerant.

As described above, distributor 10 in the present embodiment can have a size reduced to a minimum required size while evenly distributing gas-liquid two-phase refrigerant, which has been distributed unevenly in a conventional distributor. Distributor 10 having a minimum required size reduced as described above can accordingly contribute to reductions in material cost and mounting space.

The refrigeration cycle apparatus in the present embodiment, which includes distributor 10 described above, can thus achieve the function and effect described above.

Embodiment 2

Figure 7:
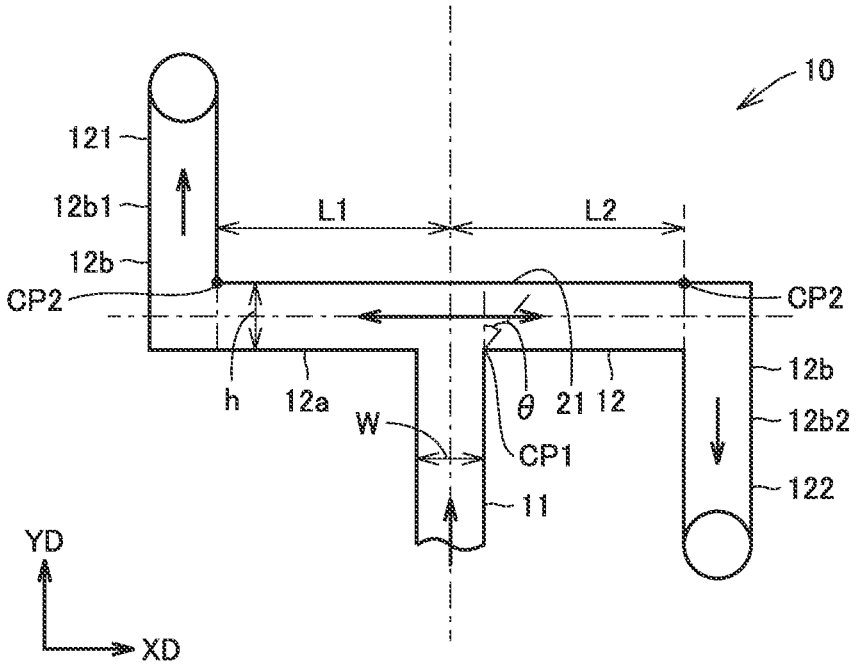
FIG. 7 schematically shows a distributor in Embodiment 2 of the present invention.
Figure 8:
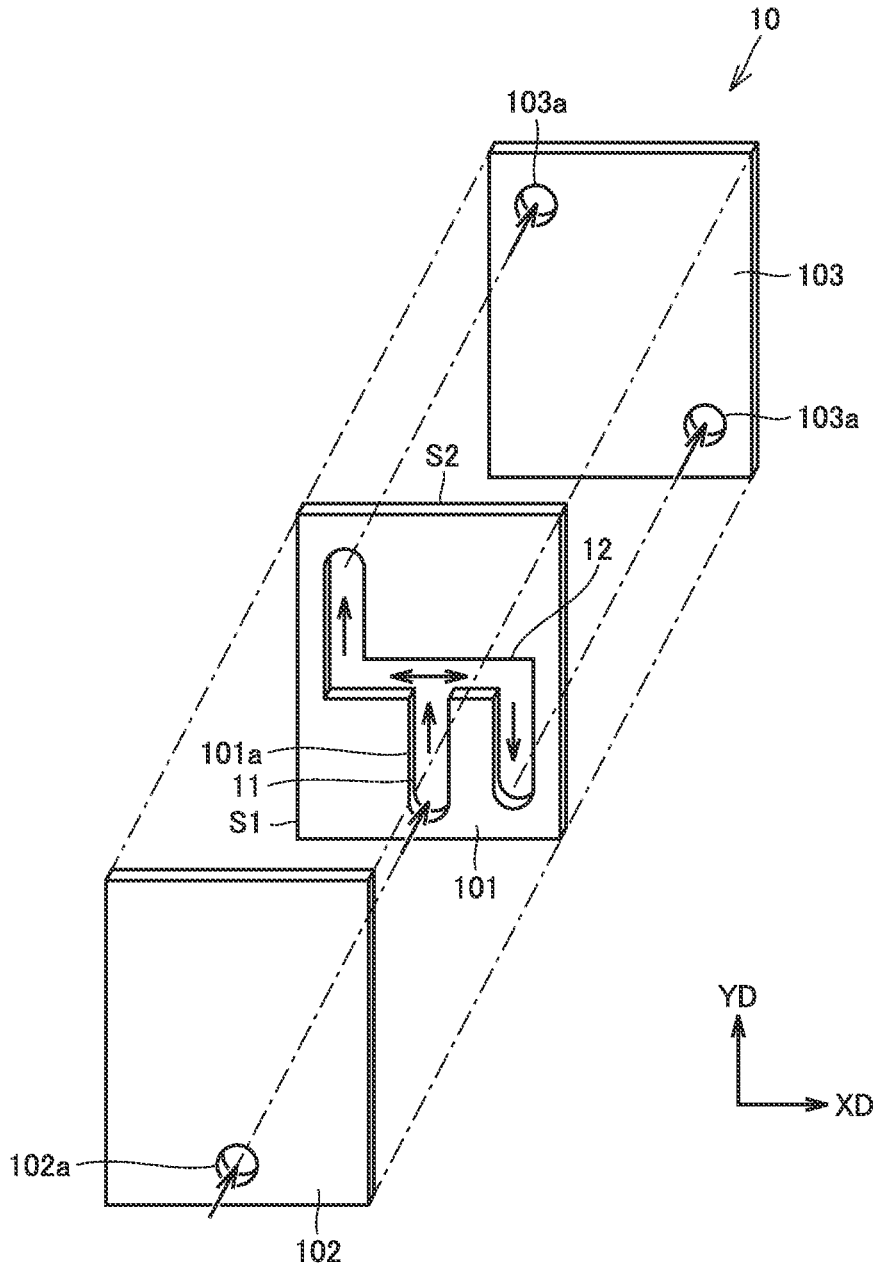
FIG. 8 is an exploded view of a distributor in Modification 1 of Embodiment 2 of the present invention.
Figure 9:
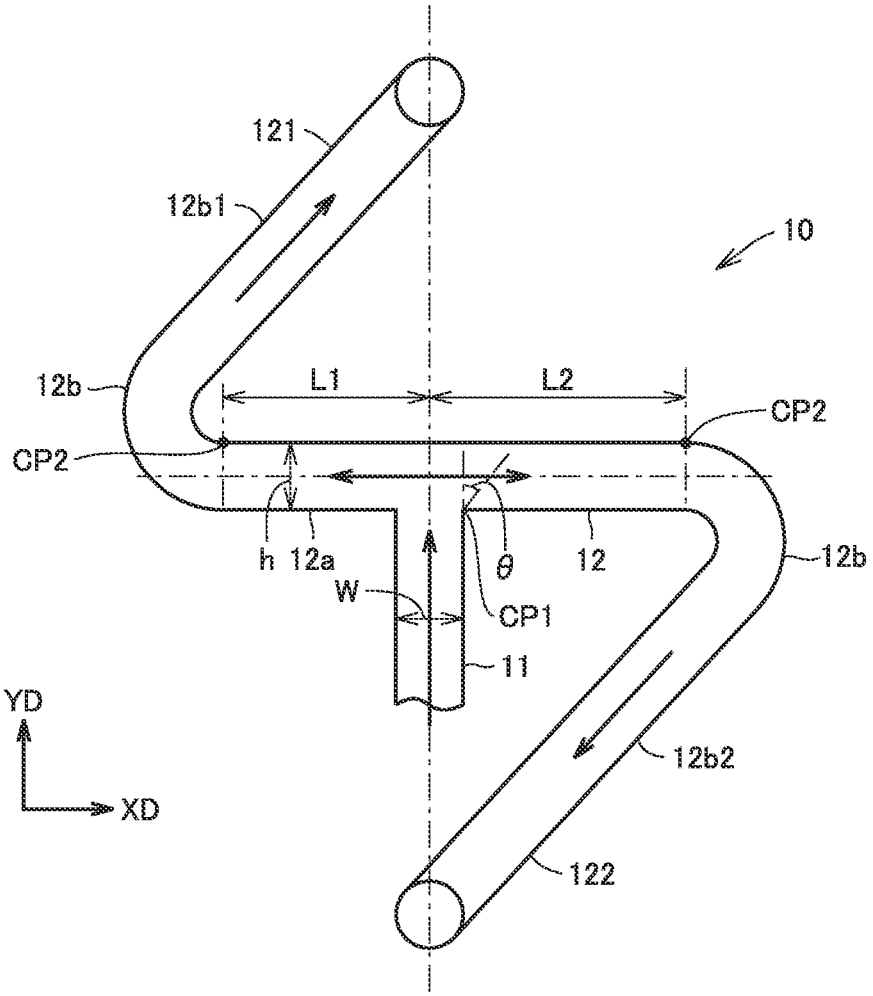
FIG. 9 schematically shows a distributor in Modification 2 of Embodiment 2 of the present invention.

With reference to FIGS. 7 to 9, Embodiment 2 of the present invention will describe a mode in which the opposite ends of downstream flow path 12 run in second direction XD and change their directions of travel in a curved manner or at a right angle, and subsequently, travel in first direction YD or a synthetic direction of first direction YD and second direction XD.

Distributor 10 in the present embodiment as shown in FIG. 7 will be described in detail. FIG. 7 schematically shows distributor 10 in the present embodiment. As shown in FIG. 7, downstream flow path 12 is configured in an S shape. Downstream flow path 12 has a first downstream flow path portion 121 and a second downstream flow path portion 122. First downstream flow path portion 121 is configured to travel a distance L1 from the central axis of upstream flow path 11 in the negative direction of second direction XD, change the direction of travel at a right angle, and then travel in the positive direction of first direction YD. Second downstream flow path portion 122 is configured to travel a distance L2 from the central axis of upstream flow path 11 in the positive direction of second direction XD, change the direction of travel at a right angle, and then travel in the negative direction of first direction YD. In second downstream flow path portion 122, thus, a positive-going component of a vector of the refrigerant in first direction YD is zero.

Bent portion 12*b* of downstream flow path 12 has a first downstream portion 12*b*1 and a second downstream portion 12*b*2. Second downstream portion 12*b*2 is disposed opposite to first downstream portion 12*b*1 with respect to branch portion 12*a*. First downstream portion 12*b*1 extends in the positive direction of first direction YD. First downstream portion 12*b*1 may be disposed at a right angle with respect to branch portion 12*a*. Second downstream portion 12*b*2 extends in the negative direction of first direction YD opposite to the positive direction. Second downstream portion 12*b*2 may be disposed at a right angle with respect to branch portion 12*a*.

In second downstream flow path portion 122, gas-liquid two-phase refrigerant that flows in from upstream flow path 11 needs to change the direction of travel and travel in the negative direction of first direction YD. Thus, even if length L2 does not satisfy Expression (1) above, the gas-liquid two-phase refrigerant that flows in from the flow outlet of upstream flow path 11 while spreading at spread angle θ inevitably collides with traverse wall 21.

On the other hand, in first downstream flow path portion 121, if length L1 does not satisfy Expression (1) above, the gas-liquid two-phase refrigerant that flows in from upstream flow path 11 has spread angle θ, and accordingly, travels without colliding with traverse wall 21. Thus, length L1 needs to satisfy Expression (1) above. On the other hand, length L2 is not limited to Expression (1) above.

Referring to FIG. 8, distributor 10 in the present embodiment may be configured by overlaying plate-shaped bodies on each other. FIG. 8 is an exploded perspective view of distributor 10 in Modification 1 of the present embodiment.

As shown in FIG. 8, distributor 10 in Modification 1 of the present invention includes a first plate 101, a second plate 102, and a third plate 103. First plate 101, second plate 102, and third plate 103 are overlaid on each other. In other words, first plate 101, second plate 102, and third plate 103 are stacked on each other. First plate 101, second plate 102, and third plate 103 may have an equal plate thickness.

First plate 101 has a first surface S1 and a second surface S2 opposite to first surface S1. First plate 101 is provided with a channel 101*a* passing through first surface S1 and second surface S2. Second plate 102 is attached to first surface S1 of first plate 101. Second plate 102 is provided with a flow inlet 102*a* communicating with channel 101*a*. Third plate 103 is attached to second surface S2 of first plate 101. Third plate 103 is provided with flow outlets 103*a* communicating with channel 101*a*.

Channel 101*a* of first plate 101 configures upstream flow path 11 and downstream flow path 12. Flow inlet 102*a* of second plate 102 is connected to upstream flow path 11. Flow outlets 103*a* of third plate 103 are connected to downstream flow path 12.

When distributor 10 is configured of a circular pipe typically used, it is difficult to form right-angle portions of first downstream flow path portion 121 and second downstream flow path portion 122. Thus, a flow path can also be formed by punching plate-shaped bodies as shown in FIG. 8 by pressing. This can improve manufacturability and reduce processing cost.

Although FIG. 8 shows distributor 10 configured of three plate-shaped bodies, namely, first plate 101, second plate 102, and third plate 103, the number of plate-shaped bodies is not limited to three. For example, each of first plate 101, second plate 102, and third plate 103 may be configured of multiple plate-shaped bodies. Also, the shape of the plate-shaped body is not limited to a rectangular shape.

The configuration of distributor 10 configured of plate-shaped bodies as shown in FIG. 8 may be used in Embodiment 2, as well as in Embodiment 1 and Embodiment 3 and Embodiment 4 described below.

Referring to FIG. 9, distributor 10 in the present embodiment may be used in a mode in which first downstream flow path portion 121 and second downstream flow path portion 122 travel in a curved flow path. FIG. 9 schematically shows distributor 10 in Modification 2 of the present embodiment. As shown in FIG. 9, first downstream flow path portion 121 is configured to be folded back in the positive direction of second direction XD. Specifically, first downstream portion 12*b*1 is configured to be inclined in the positive direction of second direction XD toward the central axis of upstream flow path 11. Second downstream flow path portion 122 is configured to be folded back in the negative direction of second direction XD. Specifically, second downstream portion 12*b*2 is configured to be inclined in the negative direction of second direction XD toward the central axis of upstream flow path 11.

Next, the function and effect of the present embodiment will be described.

In distributor 10 in the present embodiment, first downstream portion 12*b*1 extends in the positive direction of first direction YD, and second downstream portion 12*b*2 extends in the negative direction of first direction YD opposite to the positive direction. In second downstream portion 12*b*2, thus, the positive-going component of the vector of the refrigerant in first direction YD is zero. Length L2 of branch portion 12*a* to second downstream portion 12*b*2 can thus be reduced. This can reduce a size of distributor 10.

As described above, distributor 10 in the present embodiment can have length L1 in first downstream flow path portion 121 which is reduced to a minimum required length within the range that satisfies Expression (1) above and length L2 in second downstream flow path portion 122 that can be reduced without being restricted by Expression (1) above. Thus, distributor 10 in the present embodiment can have a size reduced to a minimum required size while evenly distributing gas-liquid two-phase refrigerant, which has been distributed unevenly in a conventional distributor. Distributor 10 having a minimum required size reduced as described above can accordingly contribute to reductions in material cost and mounting space.

In distributor 10 in Modification 1 of the present embodiment, channel 101*a* of first plate 101 configures downstream flow path 12, and accordingly, downstream flow path 12 can be configured in an appropriate shape (e.g., right-angle shape) by punching first plate 101 by pressing. This improves manufacturability and reduces processing cost.

Embodiment 3

Figure 10:
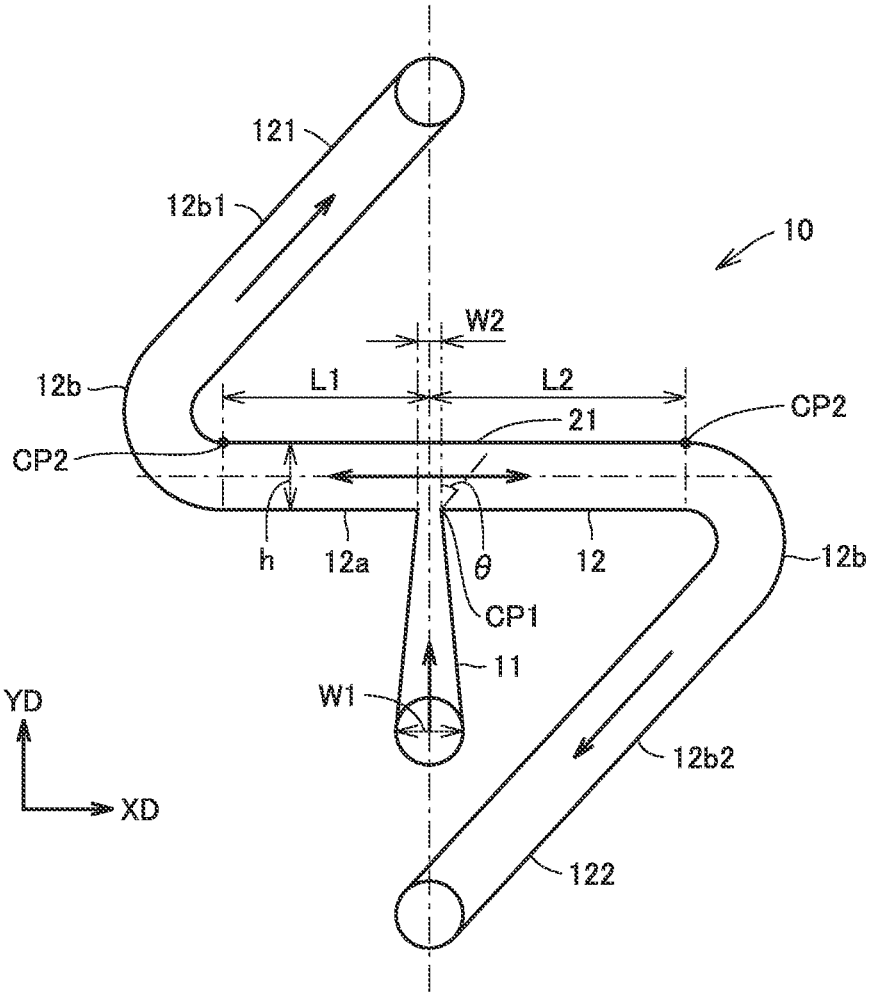
FIG. 10 schematically shows a distributor in Embodiment 3 of the present invention.

Referring to FIG. 10, Embodiment 3 of the present invention will describe a mode in which a flow path width of upstream flow path 11 shown in Embodiment 2 decreases from upstream to downstream. FIG. 10 schematically shows distributor 10 in the present embodiment. As shown in FIG. 10, in distributor 10 in the present embodiment, upstream flow path 11 has a first width W1 and a second width W2. First width W1 is a width of a portion disposed upstream of first connecting portion CP1 in refrigerant flow. Second width W2 is a width of a portion connected to first connecting portion CP1. Second width W2 is smaller than first width W1. Upstream flow path 11 is configured to decrease from first width W1 to second width W2. Upstream flow path 11 has a tapered shape continuously decreasing from first width W1 to second width W2.

In distributor 10 in the present embodiment, the flow path width of upstream flow path 11 decreases from first width W1 to second width W2, and accordingly, spreading of the refrigerant from the flow outlet of upstream flow path 11 to traverse wall 21 can be restrained. In such a case, Expression (1) above has relations of Expression (3) below and Expression (2).

$$L1 \geq h \tan \theta + 0.5W2 \quad (3)$$

Next, the function and effect in the present embodiment will be described.

In distributor 10 in the present embodiment, upstream flow path 11 is configured to decrease from first width W1 to second width W2. Thus, length L1 and length L2 from the flow outlet of upstream flow path 11 to bent portion 12*b* can be reduced. This can reduce a size of distributor 10.

As described above, distributor 10 in the present embodiment can have length L1 in first downstream flow path portion 121 which is reduced to be smaller than in Embodiment 2. Distributor 10 in the present embodiment can thus have a size reduced to a minimum required size while evenly distributing gas-liquid two-phase refrigerant, which has been distributed unevenly in a conventional distributor. Distributor 10 having a minimum required size reduced as described above can accordingly contribute to reductions in material cost and mounting space.

Embodiment 4

Figure 11:
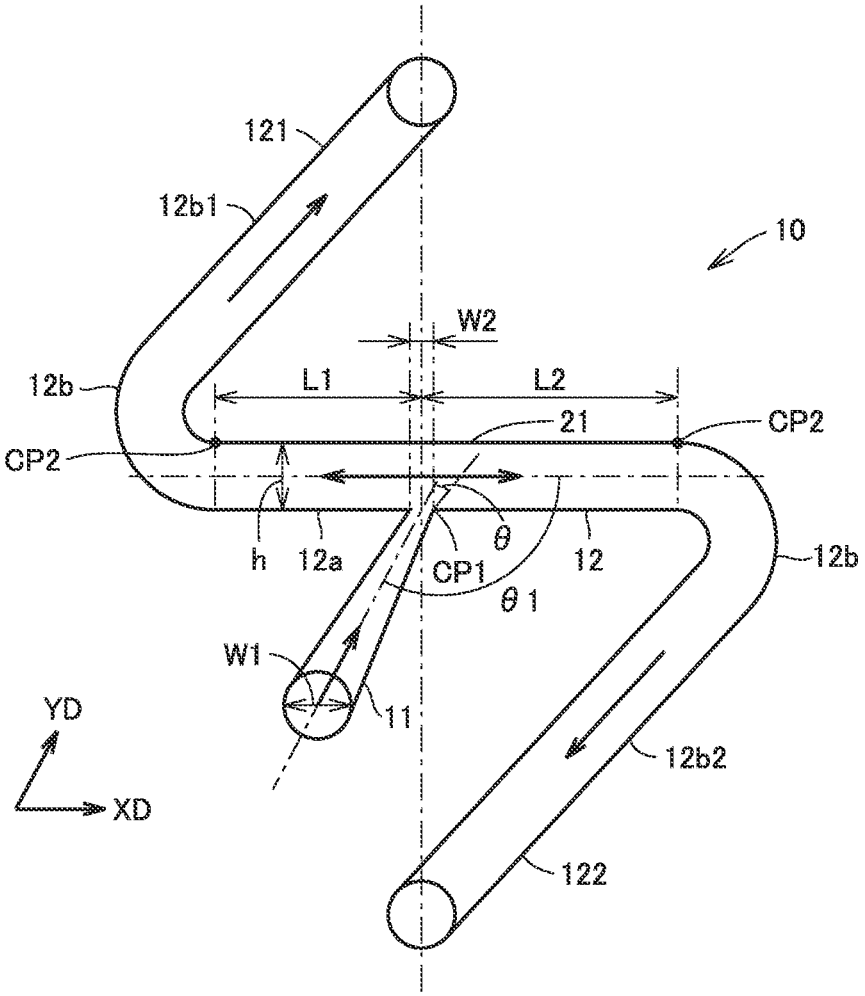
FIG. 11 schematically shows a distributor in Embodiment 4 of the present invention.

Referring to FIG. 11, Embodiment 4 of the present invention will describe a mode in which the central axis of upstream flow path 11 described and shown in Embodiment 3 has an inclination angle θ1 with respect to the central axis of branch portion 12*a* of downstream flow path 12.

FIG. 11 schematically shows distributor 10 in the present embodiment. As shown in FIG. 11, in distributor 10 in the present embodiment, first direction YD is inclined with respect to the direction orthogonal to second direction XD. Upstream flow path 11 may be configured to be inclined with respect to the direction of gravity. Upstream flow path 11 is inclined toward second downstream portion 12*b*2 extending in the negative direction of first direction YD. In other words, upstream flow path 11 is inclined opposite to first downstream portion 12*b*1 extending in the positive direction of first direction YD.

Upstream flow path 11 is inclined at an inclination angle θ1 from the central axis of branch portion 12*a*. Thus, spreading of the refrigerant from the flow outlet of upstream flow path 11 to traverse wall 21 can be restrained. Inclination angle θ1 is as shown in Expressions (4) and (5) below.

$$82° \leq \theta 1 < 90° \quad (4)$$

$$90° < \theta 1 \leq 98° \quad (5)$$

When θ1 is out of the range represented by Expressions (4) and (5), the refrigerant that flows out of upstream flow path 11 has a large amount of kinetic energy for travel in second direction XD, and accordingly, a large amount of refrigerant flows to downstream flow path 12 in the direction of travel without being evenly distributed to two branches even when the refrigerant has collided with traverse wall 21. The inventor has found through experimental research that a kinetic energy component for travel in second direction XD is negligibly small when inclination angle θ1 is within the range represented by Expressions (4) and (5).

Next, the function and effect of the present embodiment will be described.

In distributor 10 in the present embodiment, first direction YD is inclined with respect to the direction orthogonal to second direction XD. Thus, as upstream flow path 11 is inclined with respect to bent portion 12*b* extending in the positive direction of first direction YD, refrigerant can less easily flow into bent portion 12*b*. This can reduce a size of distributor 10.

As described above, distributor 10 in the present embodiment can have length L1 of first downstream flow path portion 121 which is reduced to be smaller than in Embodiment 3. Distributor 10 in the present embodiment can have a size reduced to a minimum required size while evenly distributing gas-liquid two-phase refrigerant, which has been distributed unevenly in a conventional distributor. Distributor 10 having a minimum required size reduced as described above can accordingly contribute to reductions in material cost and mounting space.

The above embodiments can be combined as appropriate.

It should be construed that the embodiments disclosed herein are given by way of illustration in all respects, not by way of limitation. It is therefore intended that the scope of the present invention is defined by claims, not only by the embodiments described above, and encompasses all modifications and variations equivalent in meaning and scope to the claims.

REFERENCE SIGNS LIST

1 compressor; 2 four-way valve; 3 indoor heat exchanger; 4 expansion valve; 5 outdoor heat exchanger; 6 outdoor fan; 7 indoor fan; 10 distributor; 11 upstream flow path; 12 downstream flow path; 12*a* branch portion; 12*b* bent portion; 12*b*1 first downstream portion; 12*b*2 second downstream portion; 100 refrigeration cycle apparatus; 101 first plate; 101*a* channel; 102 second plate; 102*a* flow inlet; 103 third plate; 103*a* flow outlet; 121 first downstream flow path portion; 122 second downstream flow path portion; CP1 first connecting portion; CP2 second connecting portion; S1 first surface; S2 second surface; W1 first width; W2 second width; XD second direction; YD first direction.

The invention claimed is:

1. A distributor comprising:

an upstream flow path extending in a first direction; and a downstream flow path located downstream of the upstream flow path in a refrigerant flow, the downstream flow path having a branch portion having a first connecting portion connected to the upstream flow path to branch the refrigerant flow from the first connecting portion in a second direction intersecting the first direction, a bent portion having a second connecting portion connected to the branch portion, the bent portion being located downstream of the branch portion in the refrigerant flow, the second connecting portion of the bent portion being located downstream of the first connecting portion of the branch portion in the refrigerant flow, the upstream flow path has a first width of a portion disposed upstream of the first connecting portion in the refrigerant flow, and a second width of a portion connected to the first connecting portion, the upstream flow path is configured to decrease from the first width to the second width, the upstream flow path has a tapered shape continuously decreasing from the first width to the second width, and the tapered shape extends to and terminates at the first connecting portion, wherein in the second direction, a length between the first connecting portion and the second connecting portion is greater than or equal to a dimension obtained by multiplying a width of the branch portion in the first direction by tan 15°.

2. The distributor according to claim 1, wherein in the second direction, a length between the first connecting portion and the second connecting portion is smaller than or equal to a width of the upstream flow path.

3. The distributor according to claim 1, wherein the first direction is inclined with respect to a direction orthogonal to the second direction.

4. A refrigeration cycle apparatus comprising a distributor according to claim 1.

5. A distributor comprising:

an upstream flow path extending in a first direction; and a downstream flow path located downstream of the upstream flow path in a refrigerant flow, the downstream flow path having a branch portion having a first connecting portion connected to the upstream flow path to branch the refrigerant flow from the first connecting portion in a second direction intersecting the first direction, a bent portion having a second connecting portion connected to the branch portion, the bent portion being located downstream of the branch portion in the refrigerant flow, the second connecting portion of the bent portion being located downstream of the first connecting portion of the branch portion in the refrigerant flow, the upstream flow path has a first width of a portion disposed upstream of the first connecting portion in the refrigerant flow, and a second width of a portion connected to the first connecting portion, the upstream flow path is configured to decrease from the first width to the second width, the upstream flow path has a tapered shape continuously decreasing from the first width to the second width, and the tapered shape extends to and terminates at the first connecting portion, wherein the bent portion has a first downstream portion, and a second downstream portion located opposite to the first downstream portion with respect to the branch portion, the first downstream portion extends in a positive direction of the first direction, and the second downstream portion extends in a negative direction of the first direction opposite to the positive direction.

6. A distributor comprising:

an upstream flow path extending in a first direction; and a downstream flow path located downstream of the upstream flow path in a refrigerant flow, the downstream flow path having a branch portion having a first connecting portion connected to the upstream flow path to branch the refrigerant flow from the first connecting portion in a second direction intersecting the first direction, a bent portion having a second connecting portion connected to the branch portion, the bent portion being located downstream of the branch portion in the refrigerant flow, the second connecting portion of the bent portion being located downstream of the first connecting portion of the branch portion in the refrigerant flow, the upstream flow path has a first width of a portion disposed upstream of the first connecting portion in the refrigerant flow, and a second width of a portion connected to the first connecting portion, the upstream flow path is configured to decrease from the first width to the second width, the upstream flow path has a tapered shape continuously decreasing from the first width to the second width, and the tapered shape extends to and terminates at the first connecting portion, the distributor further comprising a first plate having a first surface and a second surface opposite to the first surface, the first plate being provided with a channel passing through the first surface and the second surface;

a second plate attached to the first surface of the first plate and being provided with a flow inlet communicating with the channel; and a third plate attached to the second surface of the first plate and being provided with a flow outlet communicating with the channel, wherein the channel of the first plate configures the upstream flow path and the downstream flow path, the flow inlet of the second plate is connected to the upstream flow path, and the flow outlet of the third plate is connected to the downstream flow path.

* * * * *